US005574493A

United States Patent [19]

Sanger et al.

[11] Patent Number: 5,574,493

[45] Date of Patent: Nov. 12, 1996

[54] VACUUM COLLECTION SYSTEM FOR DYE-ABLATION PRINTING PROCESS

[75] Inventors: Kurt M. Sanger, Rochester; Lee W. Tutt, Webster; James B. Geist, Holley; Seung H. Baek, Pittsford, all of N.Y.

[73] Assignee: Eastman Kodak Company, Rochester, N.Y.

[21] Appl. No.: 212,098

[22] Filed: Mar. 11, 1994

[51] Int. Cl.[6] ..... B41J 2/435

[52] U.S. Cl. ..... 347/262; 358/299

[58] Field of Search ..... 347/262, 264; 358/299

[56] References Cited

U.S. PATENT DOCUMENTS

| | | | |
|---|---|---|---|
| 4,973,572 | 11/1990 | DeBoer | 503/227 |
| 5,088,864 | 2/1992 | Yanagida | 358/299 |
| 5,266,532 | 11/1993 | Russell et al. | 358/299 |

FOREIGN PATENT DOCUMENTS 2083726 3/1982 United Kingdom .

WO92/06410 4/1992 WIPO .

*Primary Examiner*—Mark J. Reinhart
*Attorney, Agent, or Firm*—Milton S. Sales

[57] ABSTRACT

An ablated materials collection apparatus for a laser dye ablation printing process includes a set of walls to define a vacuum chamber open towards the platen surface, a vacuum source which communicates with the vacuum chamber through an opening in the walls on the crosstrack side of the vacuum chamber away from areas of the recording element already written and on the intrack side of the vacuum chamber downstream with respect to the direction of scan. A heat source for the vacuum chamber inhibits adherence of ablated material to surfaces of the vacuum chamber, and a solvent application prevents buildup of ablated material on surfaces of the vacuum chamber. An electrostatic air cleaner and a carbon filter clean the discharge air. The wall set defines a semicylindrical end surface which substantially conforms to the cylindrical shape of the platen surface to thereby form a close fit with the platen surface such that the platen surface forms a wall of the vacuum chamber.

10 Claims, 2 Drawing Sheets

VACUUM COLLECTION SYSTEM FOR DYE-ABLATION PRINTING PROCESS

BACKGROUND OF THE INVENTION

1. Technical Field

This invention relates generally to dye-ablative recording apparatus, and more particularly to an apparatus and process for collecting ablated materials and gasses to inhibit their deposit on critical parts of the system and to removing contaminants from the air.

2. Background Art

As used herein, the term "ablation" is intended to include removal of material by melting, vaporization, evaporation, sublimation, etc. In dye-ablation printing processes, a donor sheet including a material which strongly absorbs at, say, laser wavelength is irradiated. The absorbing material converts radiant energy to thermal energy, and transfers the heat to a dye in the immediate vicinity; thereby heating the dye to its vaporization (ablation) temperature. Further details of this process are found in GB 2,083,726A, the disclosure of which is hereby incorporated by reference.

In one ablative mode of laser imaging, a dye-ablative recording element includes an image dye, a light absorbing material, and a binder coated onto a substrate. The energy provided by the laser drives off the image dye at the spot where the laser beam hits the element, and leaves the binder behind. In ablative imaging, the laser radiation causes rapid local changes in the imaging layer, thereby causing the material to be ejected from the layer.

In some laser dye-ablation printing systems, the ablated material is physically transferred to a receiver medium. In such systems, the ablated material does not present a contamination problem. However, in other laser dye-ablation printing systems, the ablated dye explodes off the support into the surrounding air. Some of the ablated material in the surrounding air collects on the laser optics and deposits on the already-written portions of the recording element. The material build-up on the laser optics soon blocks much of the light, causing the printed minimum density $D_{min}$ to unacceptably increase. Deposit of the ablated material on the already-written portions of the recording element degrades the image by increasing the level of the $D_{min}$ of the image.

Commonly assigned U.S. Pat. No. 4,973,572 discloses a laser-induced thermal dye transfer element in which a positive image is obtained in the dye transfer element by imaging from the dye side of the element and blowing sublimed dye from the surface using a stream of compressed air. In large quantities, the "dust" of removed dye would be a problem.

DISCLOSURE OF INVENTION

It is an object of the present invention to provide an apparatus for collecting ablated material to inhibit contamination of the system optics and of the written recording element.

According to one feature of the present invention, a materials collection apparatus for a dye-ablation printer includes a vacuum chamber open towards the printer platen, a vacuum source which is connected to the vacuum chamber through an opening in the wall means wherein the opening is on the crosstrack side of the vacuum chamber away from areas of the recording element already written, so that the ablated material is drawn over unwritten portions of the recording element and blow back of ablated materials onto previously written areas is inhibited.

According to another feature of the present invention, a materials collection apparatus for a dye-ablation printer includes a vacuum chamber open towards the printer platen, a vacuum source which is connected to the vacuum chamber through an opening in the wall means wherein the opening is on the intrack side of the vacuum chamber downstream with respect to the direction of scan to take full advantage of scan velocity.

According to still another feature of the present invention, a materials collection apparatus for a dye-ablation printer includes a vacuum chamber open towards the printer platen, a vacuum source which is connected to the vacuum chamber through an opening in the vacuum chamber wall so that the ablated material is drawn from the vacuum chamber, and a heat source adapted to apply heat to the vacuum chamber, whereby adherence of ablated material to surfaces of the vacuum chamber is inhibited. The heat source may be an electrically resistive element attached in heat conductive contact with the wall of the vacuum chamber.

According to yet another feature of the present invention, a materials collection apparatus for a dye-ablation printer includes a vacuum chamber open towards the printer platen, a vacuum source which is connected to the vacuum chamber through an opening in the vacuum chamber walls so that the ablated material is drawn from the vacuum chamber, and means for applying a solvent into the vacuum chamber so that buildup of ablated material to surfaces of the vacuum chamber is inhibited.

In a preferred embodiment of the present invention, an electrostatic air cleaner is provided in the connection of the vacuum source with the vacuum chamber for removing ablated material from air discharged from the vacuum source. Also, a carbon filter may be positioned in the connection of the vacuum source with the vacuum chamber between the vacuum source and the air cleaner.

According to another feature of the present invention, an ablated materials collection apparatus for a printing process of the type using a platen having a surface for receiving an ablation materials recording element and a source of high energy radiation adapted to selectively irradiate portions of the received recording element to drive off the ablated materials from the recording element includes a set of walls defining a vacuum chamber open towards the platen surface such that the wall set defines an end surface which substantially conforms to the shape of the platen surface to thereby form a close fit with the platen surface such that the platen surface forms a wall of the vacuum chamber. A vacuum source is connected to the vacuum chamber through an opening in the vacuum chamber walls, whereby the ablated material is drawn from the vacuum chamber. In a preferred embodiment, the platen surface is cylindrical and the end surface of the set of walls is semicylindrical. The chamber forming means may include a lens barrel, and the lens barrel may carry an imaging lens system having a final lens exposed to the interior of the vacuum chamber.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
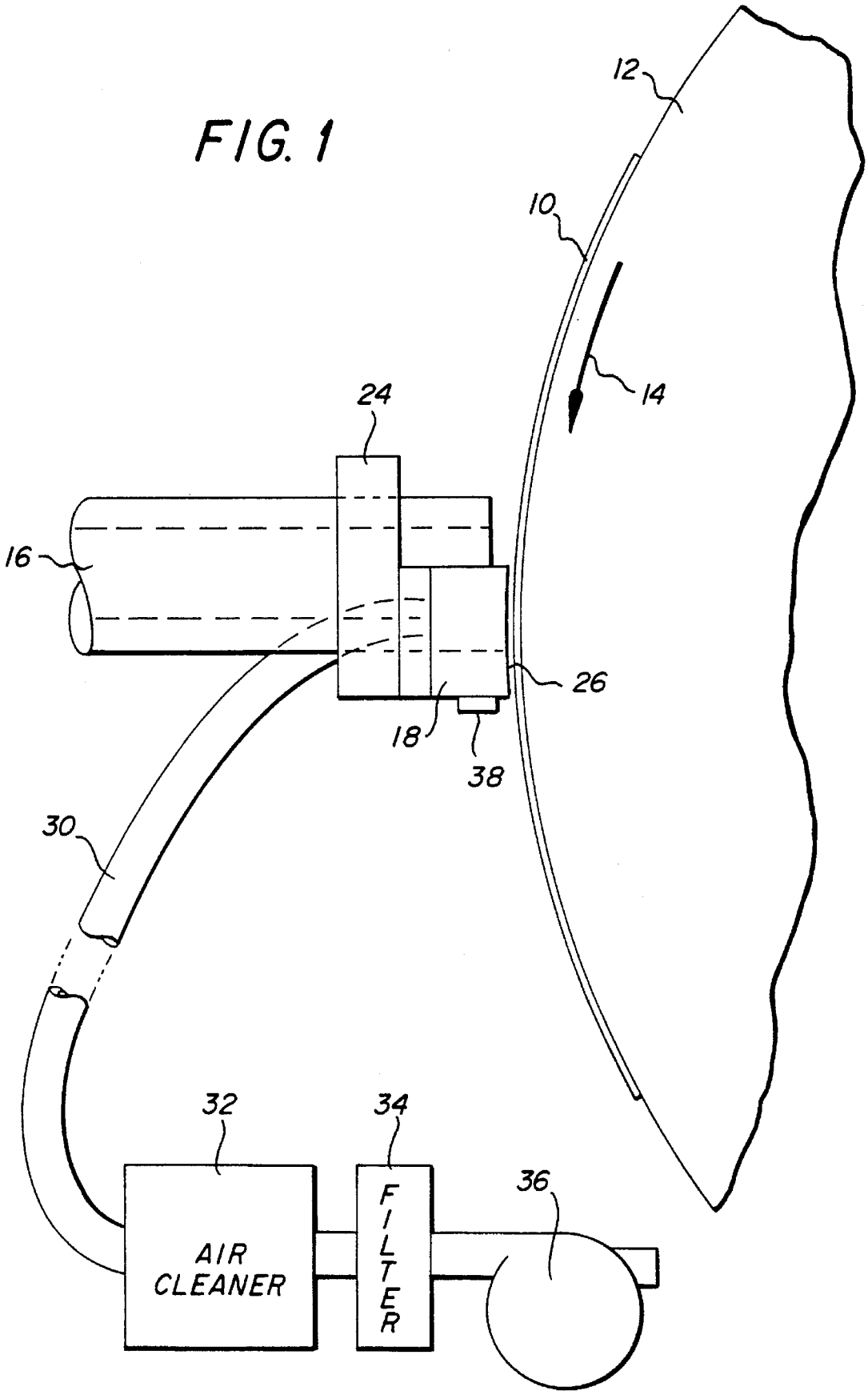
FIG. 1 is a schematic side elevation view of a vacuum collection system for a laser dye-ablation printing process according to the present invention.

Referring to FIG. 1, a dye-ablation recording element 10 is attached by suitable means to the surface of a platen such as the cylindrical outer surface of a drum 12. The drum is rotatable in the direction of an arrow 14. The recording element is shown in sheet form, but it will be understood that the element could be supplied as a roll of web material. The recording element includes an image dye, a light absorbing material, and a binder coated onto the surface of a substrate.

Figure 2:
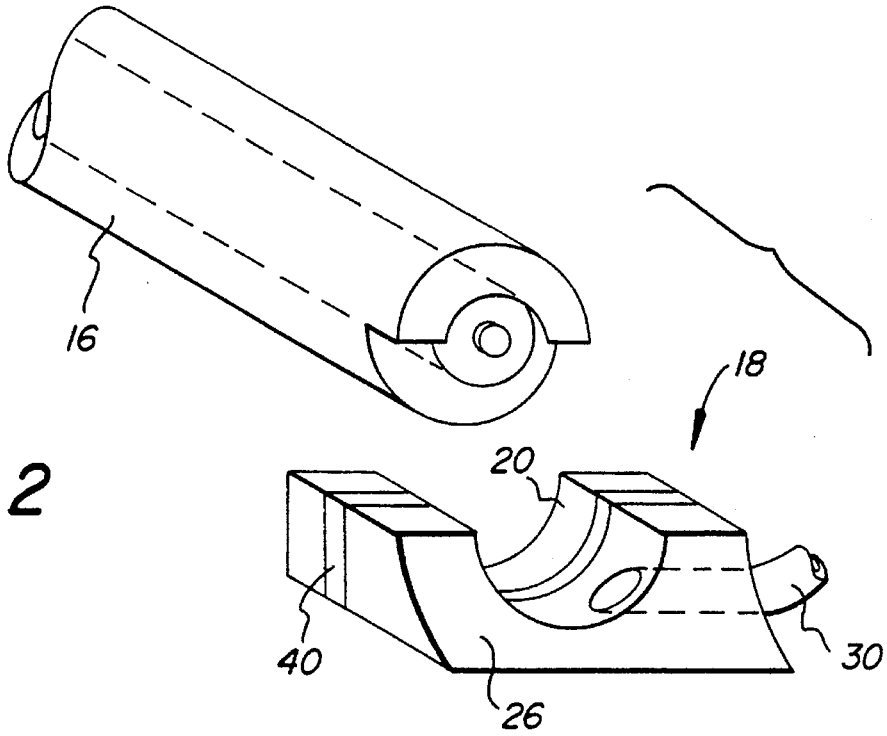
FIG. 2 is an exploded view of a detailed portion of the system of FIG. 1.

Shown in FIG. 1, and in greater detail in FIG. 2, a cylindrical lens barrel 16 carries the final imaging lens system for a laser, not shown, or other source of high energy radiation. When mounted in the printer, lens barrel 16 moves axially along drum 12 to scan across recording element 10. Details of the mounting and translation apparatus are not shown for clarity, but may take any of several suitable forms well known in the art.

The energy provided by the laser drives off the image dye at the spot where the laser beam hits the recording element, and degrades the binder. In ablative imaging, the laser radiation causes rapid local changes in the imaging layer, thereby causing the material to be ejected from the layer.

As best seen in FIG. 2, lens barrel 16 is formed with a semicylindrical notch at the end facing drum 12. The notch can be formed in the barrel by any suitable means, such as by machining. In the orientation of the drawings, the notch is on the bottom of the lens barrel, but the intent is to have the notch on the downstream side of the lens barrel relative to the direction of rotation of drum 12. This is perhaps clearer seen in FIG. 1.

The notch in lens barrel 16 is sized to receive a vacuum orifice box 18. The vacuum orifice box has a semicylindrical inner face 20 which, when the orifice box is received in the notch of lens barrel 16, conforms with the inner cylindrical wall of the lens barrel to define a vacuum chamber having an open end facing drum 12. Orifice box 18 can be attached to the lens barrel by any suitable means such as by screws or, as shown in FIG. 1, a clamp 24.

Front face 26 of vacuum orifice box 18 is curved to follow the contour of drum 12. When the lens barrel is positioned close to the drum, the curve in the front face of the vacuum box forms closely with the drum surface so that the cylindrical surface of the drum, or of a recording element on the drum serves as a wall of the vacuum chamber.

A vacuum tube 30 communicates with the interior chamber of vacuum orifice box 18 to remove air and ablated material. The tube is positioned so as to be on the lateral side of the orifice box away from the material previously written. This draws the ablated material over unwritten portions of the medium and reduces the problem of blow back of contaminates onto the previously written surface. If ablated material is drawn over previously written image, a substantial portion of the ablated material (blow back) will stick to the image. Note also that the vacuum tube communication with the interior chamber of the vacuum orifice box is on the downstream side with respect to the direction of rotation of drum 12 to take full advantage of the rotational velocity of the drum.

The discharge end of vacuum tube 30 is connected to an electrostatic air cleaner 32, which is in turn connected to a carbon filter 34. An electrostatic air cleaner charges the particles, which are then deposited onto oppositely charged plates. Carbon particles in the final filter eliminate any possible odors and/or gasses of volatile organic compounds in the air discharged from a blower 36.

According to a feature of the present invention, it has been found that the application of heat to the vacuum chamber decreases the amount of ablated material that adheres to the surfaces therein, and thus reduces the cleaning requirements. In the illustrated embodiment, a small electrical resistive element 38 has been attached in heat conductive contact with the walls of the vacuum orifice box. Heat could be applied by other means, such as for example by heat gun. It is believed that the heat melts and sublimes the accumulated contaminants, allowing the vacuum to pull them though the tubing. A thermal insulator 40 inhibits heat transfer to lens barrel 16.

Built up materials can be cleaned by squirting acetone or other suitable solvent directly into the vacuum stream with the vacuum applied. Maintenance squirts of solvent between prints reduce unwanted build up and allow more prints between cleanings. A suitable solvent-applying device 42 is schematically shown in FIG. 3, but those skilled in the art will recognize that the device may take any of several forms.

Figure 3:
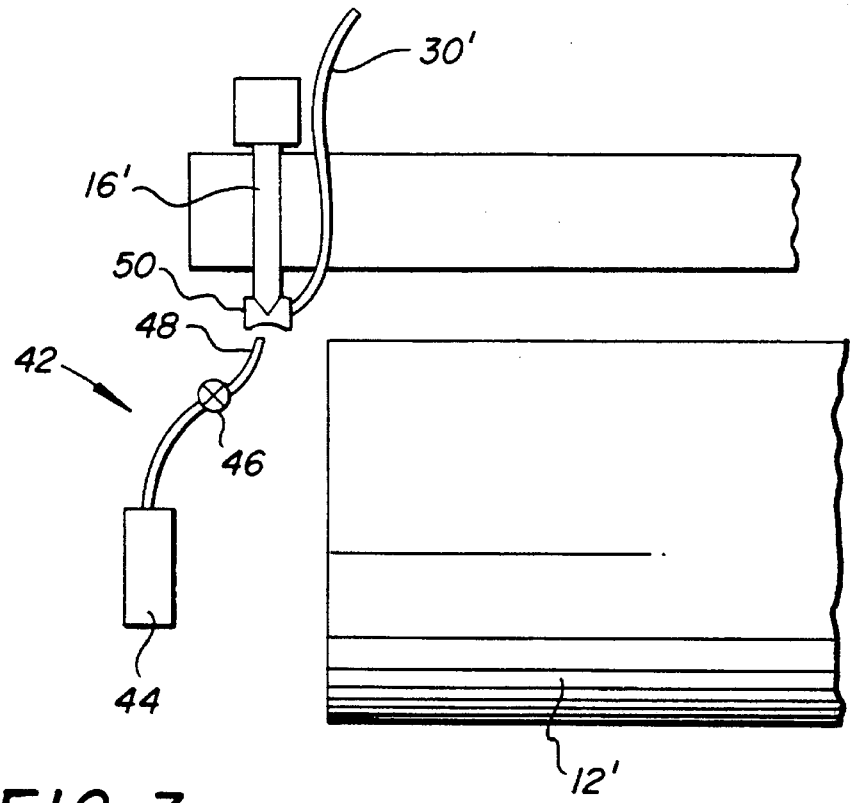
FIG. 3 is a schematic top view of a second embodiment of the vacuum collection system according to the present invention.

Referring to FIG. 3, solvent-applying device 42 includes a supply 44 of solvent under pressure, a valve 46, and a nozzle 48. The device is fixed on the apparatus such that nozzle 48 aligns with ablated materials collection apparatus 50 when the apparatus returns to its "cleaning station" position at the left of its travel as illustrated in the figure. When valve 46 is opened, solvent flows to the apparatus.

A further review of FIG. 3 shows that ablated materials collection apparatus does not include a vacuum chamber. To provide for an increased gap between drum 12' and the collection apparatus. Without a vacuum chamber, the end of vacuum tube 30' is positioned on the crosstrack side of lens barrel 16' away from the areas of the recording element already written, whereby the ablated material is drawn over unwritten portions of the recording element on drum 12', and whereby blow back of ablated materials onto previously written areas is inhibited.

The invention has been described in detail with particular reference to preferred embodiments thereof, but it will be understood that variations and modifications can be effected within the spirit and scope of the invention.

What is claimed is:

1. An apparatus for a printing process, said apparatus comprising:

a platen having a surface for receiving an ablation materials recording element;

a source of high energy radiation adapted to selectively irradiate portions of the received recording element to drive off the ablated materials from the recording element;

means for raster scanning in a crosstrack direction and an intrack direction the recording element with radiation from the source; and an ablated materials collection apparatus comprising:

wall means for defining a vacuum chamber open towards the platen surface, and a vacuum source which communicates with the vacuum chamber through an opening in the wall means, said opening being on the crosstrack side of the vacuum chamber away from areas of the recording element already written, whereby the ablated material is drawn over unwritten portions of the recording element and blow back of ablated materials onto previously written areas is inhibited.

2. An apparatus for a printing process, said apparatus comprising:

a platen having a surface for receiving an ablation materials recording element;

a source of high energy radiation adapted to selectively irradiate portions of the received recording element to drive off the ablated materials from the recording element;

means for raster scanning in a crosstrack direction and an intrack direction the recording element with radiation from the source; and an ablated materials collection apparatus comprising:

wall means for defining a vacuum chamber open towards the platen surface, and a vacuum source which communicates with the vacuum chamber through an opening in the wall means, said opening being on the intrack side of the vacuum chamber downstream with respect to the direction of scan to take full advantage of scan velocity.

3. An apparatus for a printing process, said apparatus comprising:

a platen having a surface for receiving an ablation materials recording element;

a source of high energy radiation adapted to selectively irradiate portions of the received recording element to drive off the ablated materials from the recording element; and an ablated materials collection apparatus comprising:

wall means for defining a vacuum chamber open towards the platen surface, a vacuum source which communicates with the vacuum chamber through an opening in the wall means, whereby the ablated material is drawn from the vacuum chamber, and a heat source adapted to apply heat to the vacuum chamber, whereby adherence of ablated material to surfaces of the vacuum chamber is inhibited.

4. An apparatus as defined in claim 3 wherein said heat source is an electrically resistive element attached in heat conductive contact with the wall means of the vacuum chamber.

5. An apparatus for a printing process, said apparatus comprising:

a platen having a surface for receiving an ablation materials recording element;

a source of high energy radiation adapted to selectively irradiate portions of the received recording element to drive off the ablated materials from the recording element; and an ablated materials collection apparatus comprising:

wall means for defining a vacuum chamber open towards the platen surface, a vacuum source which communicates with the vacuum chamber through an opening in the wall means, whereby the ablated material is drawn from the vacuum chamber, and means for applying a solvent into the vacuum chamber, whereby buildup of ablated material to surfaces of the vacuum chamber is inhibited.

6. An apparatus for a printing process, said apparatus comprising:

a platen having a surface for receiving an ablation materials recording element;

a source of high energy radiation adapted to selectively irradiate portions of the received recording element to drive off the ablated materials from the recording element;

means for raster scanning in a crosstrack direction and an intrack direction the recording element with radiation from the source; and an ablated materials collection apparatus comprising a vacuum source on the crosstrack side of the vacuum chamber away from areas of the recording element already written, whereby the ablated material is dram over unwritten portions of the recording element and blow back of ablated materials onto previously written areas is inhibited.

7. An apparatus for a printing process, said apparatus comprising:

a platen having a surface for receiving an ablation materials recording element;

a source of high energy radiation adapted to selectively irradiate portions of the received recording element to drive off the ablated materials from the recording element; means for raster scanning in a crosstrack direction and an intrack direction the recording element with radiation from the source; and an ablated materials collection apparatus comprising a vacuum source on the intrack side of the radiation source downstream with respect to the direction of scan to take full advantage of scan velocity.

8. An apparatus for a printing process, said apparatus comprising:

a platen having a surface for receiving an ablation materials recording element;

a source of high energy radiation adapted to selectively irradiate portions of the received recording element to drive off the ablated materials from the recording element; and an ablated materials collection apparatus comprising:

a vacuum tube for drawing the ablated material away from the platen, and a heat source adapted to apply heat to the vacuum tube, whereby adherence of ablated material to surfaces of the vacuum tube is inhibited.

9. An apparatus as defined in claim 8 wherein said heat source is an electrically resistive element attached in heat conductive contact with the vacuum tube.

10. An apparatus for a printing process, said apparatus comprising:

a platen having a surface for receiving an ablation materials recording element;

a source of high energy radiation adapted to selectively irradiate portions of the received recording element to drive off the ablated materials from the recording element; and an ablated materials collection apparatus comprising:

a vacuum opening for drawing ablated material from the platen, and means for applying a solvent into the vacuum opening, whereby buildup of ablated material to surfaces of the vacuum opening is inhibited.

* * * * *